US005655287A

United States Patent [19]

Ushiro

[11] Patent Number: 5,655,287

[45] Date of Patent: Aug. 12, 1997

[54] LAMINATED TRANSFORMER

[75] Inventor: Tomoaki Ushiro, Nagaokakyo, Japan

[73] Assignee: Murata Manufacturing Co., Ltd., Kyoto-fu, Japan

[21] Appl. No.: 530,821

[22] Filed: Sep. 20, 1995

Related U.S. Application Data

[62] Division of Ser. No. 7,707, Jan. 22, 1993, abandoned.

[30] Foreign Application Priority Data

Jan. 31, 1992 [JP] Japan ..... 4-45940

[51] Int. Cl.[6] ..... H01F 3/02; H01F 7/06

[52] U.S. Cl. ..... 29/609; 29/603.2; 29/830; 29/412; 336/83; 336/223; 336/234

[58] Field of Search ..... 29/602.1, 603.07, 29/603.2, 603.26, 604, 607, 608, 609, 830, 414, 415, 417; 336/83, 200, 233, 234, 212

[56] References Cited

U.S. PATENT DOCUMENTS

| | | | |
|---|---|---|---|
| 3,333,334 | 8/1967 | Kuliczkowski et al. | 29/608 X |
| 3,412,461 | 11/1968 | Cochardt | 29/608 |
| 3,561,110 | 2/1971 | Feulner et al. | 29/602.1 |
| 3,613,228 | 10/1971 | Cook et al. | 29/603.2 X |
| 4,746,557 | 5/1988 | Sakamoto et al. | 29/602.1 X |
| 5,239,744 | 8/1993 | Fleming et al. | 29/602.1 |
| 5,488,765 | 2/1996 | Kubota et al. | 29/602.1 X |

*Primary Examiner*—Timothy V. Eley
*Attorney, Agent, or Firm*—Jordan and Hamburg

[57] ABSTRACT

Two parts of magnetic layers are placed so as to clamp a coil forming unit consisting of an alternated laminate of non-magnetic layers and electrode layers. The coil forming unit is surrounded by the magnetic body to form a closed magnetic circuit. When manufacturing the laminated transformer, a plurality of sets of U-shaped electrodes are deposited on non-magnetic green sheets. Then, the non-magnetic green sheets are laminated to form the coil forming unit consisting of the alternated laminate of the non-magnetic layers and the electrode layers. Magnetic green sheets are laminated thereto and clamp the non-magnetic green sheets therebetween to form a laminate. The laminate is pressed and additional magnetic body portions are formed in the center and on the side faces of the coil forming units. The laminate is pressed and cut into green elements. The green elements are sintered into monolithic bodies of the laminated transformer.

17 Claims, 7 Drawing Sheets

LAMINATED TRANSFORMER

This a division, of application Ser. No. 08/007, 707, filed Jan. 22, 1993 now abandoned.

BACKGROUND OF THE INVENTION

1. Field of the Invention

The present invention relates to a method of manufacturing a laminated transformer, and particularly to, for example, a laminated transformer in which coils are formed in a laminate constituted by laminating a plurality of ceramic layers on which electrode layers are formed.

2. Description of the Prior Art

A laminated transformer comprising an alternated laminate consisting of magnetic layers such as ferrite and coil forming electrodes, is known hitherto. As shown in FIG. 7 through FIG. 10, the laminated transformer is manufactured by laminating a plural number of magnetic green sheets 1 (hereinafter, referred to as the magnetic sheets) on which coil electrodes 2, a lead-out electrode 3, through holes 4 and a lead-out electrode 5 are formed. The coil formed by the internal electrodes 2 includes a primary coil 8 and a secondary coil 9. The lead-out electrode 3 at one end of one internal electrode 2 of the primary coil 8 is exposed to the outside. The upper internal electrode 2 is connected to the lower internal electrode 2 by the through hole 4. Meanwhile, the lead-out electrode 5 at one end of the other internal electrode 2 is exposed to the outside at the end surface opposing the lead-out electrodes 3. In such a manner, the primary coil 8 is formed by the internal electrode 2. Similarly, the secondary coil 9 is formed by the internal electrodes 2. Lead-out electrodes 6 and 7 at ends of the internal electrodes 2 are exposed to the outside at opposite surfaces. The locations are adjacent to the lead-out electrodes 3, 5. The alternated laminate of the magnetic sheets 1 and the coil forming internal electrodes 2 is pressed and sintered to form a monolithic chip body. As shown in FIG. 8, external electrodes 10*a*, 10*b*, 11*a* and 11*b* are formed on the chip body as a laminated transformer. FIG. 9 is a sectional view schematically showing an internal structure of the laminated transformer constituted in such a manner. As such, the primary coil 8 and the secondary coil 9 are embedded in the magnetic body. FIG. 10 is an equivalent circuit diagram of the laminated transformer.

Now, in order to increase the coupling coefficient between the primary and secondary coils in FIG. 9, a distance d between the coils must be reduced. But, in the above-mentioned conventional laminated transformer, as the distance d is reduced, the dielectric strength tends to drop. Particularly, since the dielectric strength of the magnetic body such as ferrite is generally small, the distance d can not be reduced. Also, even as the distance d is reduced in FIG. 9 where the primary and secondary coils are embedded in the magnetic body, the magnetic flux passes between the coil electrodes, and as a result, the coupling coefficient may drop.

SUMMARY OF THE INVENTION

The present invention has been devised in view of the problems inherent to the aforementioned conventional techniques, and therefore, it is an object thereof to provide a method of manufacturing a laminated transformer having a high dielectric strength and a large coupling coefficient.

The laminated transformer comprises a coil forming unit consisting of a alternated laminate of non-magnetic layers and electrode layers, and magnetic body portions formed to embed the coil forming unit, thereafter the non-magnetic layers and the magnetic body portions are compressed and sintered into a monolithic body. The coil forming unit is finally, surrounded by the magnetic material of the magnetic body portions to form a closed magnetic circuit.

The method of manufacturing the laminated transformer comprising the step of forming a plurality of sets of U-shaped electrodes deposited on non-magnetic green sheets, the steps of forming the coil forming unit consisting of a laminate of the non-magnetic layers with the deposited electrode layers, the step of forming the laminate by laminating magnetic green sheets and clamping the non-magnetic green sheets therebetween, the steps of pressing the laminate, the step of forming magnetic body portions in the center and on the side faces of the coil forming unit, and the step of sintering the laminate into a monolithic body.

According to the present invention, since the coil forming unit of the laminated transformer is formed by sintering the alternated laminate of the non-magnetic layers and the electrode layers, a primary coil and a secondary coil completely separated by an insulator is formed as a non-magnetic body. Thus the dielectric strength between the primary and secondary coils is strengthened. Also, since the primary and secondary coils are surrounded by the non-magnetic material, and the outside of the coil forming unit is completely covered by the magnetic body to form the closed magnetic circuit, the coupling coefficient can be increased and a high inductance can be obtained by substantially keeping the magnetic flux away between the coil electrode layers. Thereby, the laminated transformer can be miniaturized in size and adaptable for high energy applications. Besides, since the non-magnetic body having a small dielectric constant can be selected as the non-magnetic body between the primary and secondary coils, stray capacitance can be reduced and a transformer having a good high-frequency characteristic can be obtained.

By forming a plurality of sets of U-shaped electrodes deposited on the non-magnetic sheets, laminating the non-magnetic sheets, laminating the magnetic sheets by clamping the non-magnetic sheets therebetween, and pressing and cutting the laminate into individual element bodies before sintering, a plural number of laminated transformers can be manufactured and processed in lots.

In the laminated transformer according to the present invention, the dielectric strength between the primary and secondary coils can be strengthened and the coupling coefficient can be increased and a high inductance can be obtained and the small-sized laminated transformer can be obtained for high energy applications. Besides, the laminated transformer has a small stray capacitance and good high-frequency characteristics.

The method of manufacturing the laminated transformer according to the present invention has a high productivity, whereby a plural number of laminated transformers are manufactured and processed in lots.

The above and other objects, features, aspects and advantages of the present invention will become more apparent from the following detailed description of embodiments made with reference to the accompanying drawings.

DESCRIPTION OF THE PREFERRED EMBODIMENTS

In the following, a laminated transformer and a method of manufacturing the same according to the present invention will be described with reference to the drawings.

First; one embodiment of the laminated transformer according to the present invention is described with reference to FIG. 1 through FIG. 3.

Figure 1:
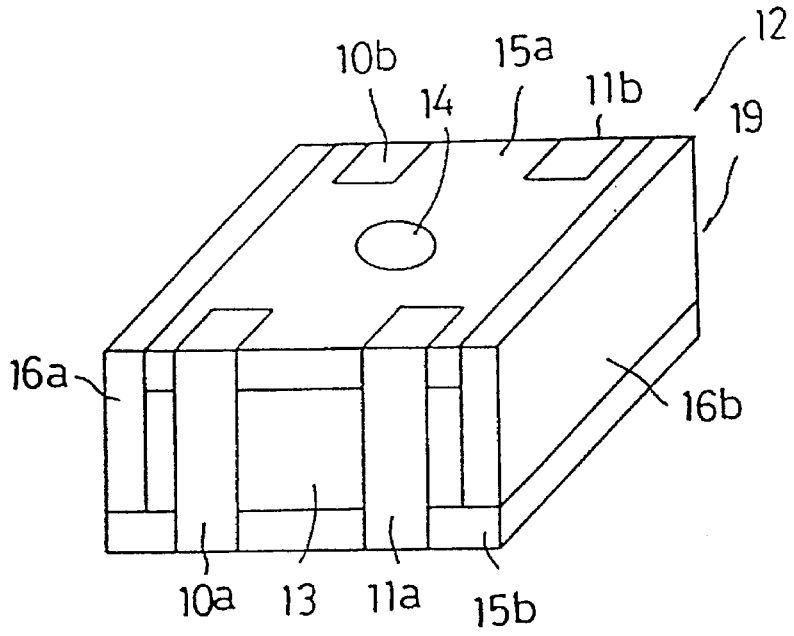
FIG. 1 is a perspective view showing one embodiment of the present invention.

FIG. 1 is a perspective view showing one embodiment of the present invention. FIG. 2 is a perspective view showing a chip which is composed and integrated from non-magnetic sheets, magnetic sheets and magnetic bodies in a manufacturing process of the laminated transformer of the embodiment shown in FIG. 1. FIG. 3(*a*) is a sectional view taken along the plane z-y passing through the center of FIG. 2. FIG. 3(*b*) is a sectional view taken along the plane y-z passing through the center of FIG. 2, and FIG. 3(*c*) is a sectional view taken along the plane z-x passing through the center of FIG. 2.

Figure 2:
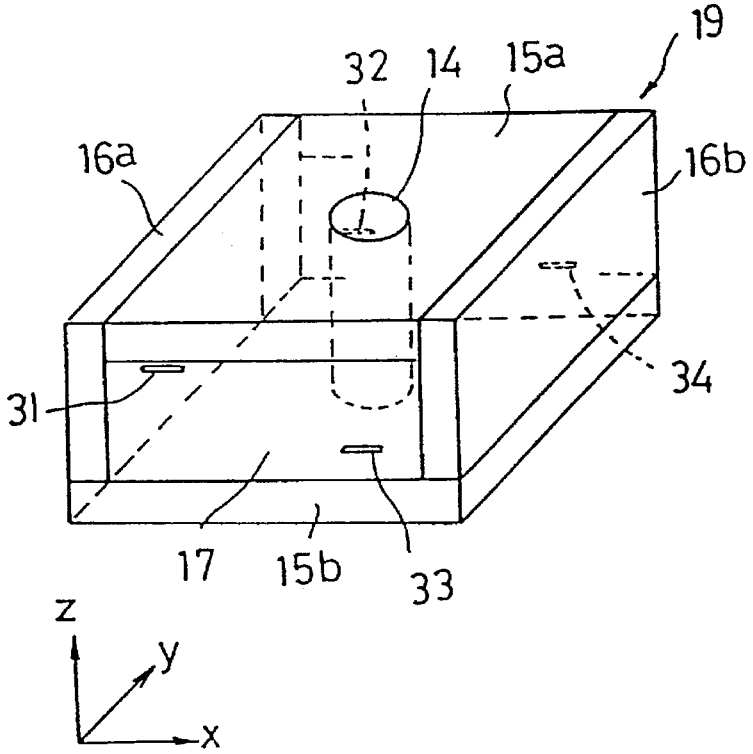
FIG. 2 is a perspective view showing a chip which is composed and integrated from non-magnetic sheets, magnetic sheets and magnetic bodies in a manufacturing process of a laminated transformer of the embodiment shown in FIG. 1.
Figure 3A:
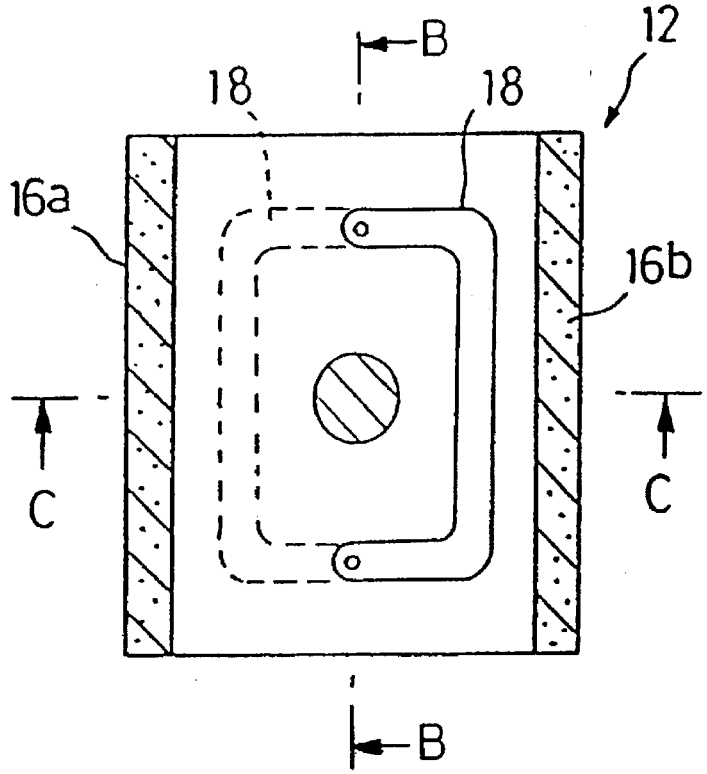
FIG. 3(*a*) is a sectional view taken on the plane x-y passing through the center of FIG. 2, FIG. 3(*b*) is a sectional view taken on the plane y-z passing through the center of FIG. 2, and FIG. 3(*c*) is a sectional view taken on the plane z-x passing through the center of FIG. 2.
Figure 3B:
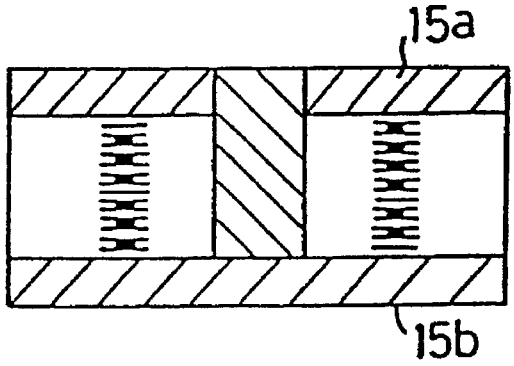
Figure 3C:
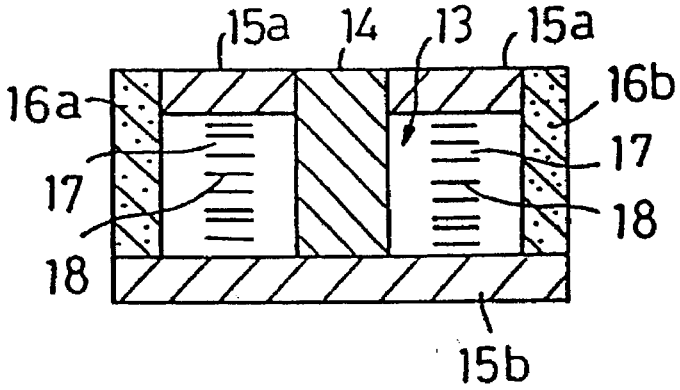

As shown in FIG. 1 through FIG. 3, a coil forming unit 13 formed by laminating non-magnetic green sheets (non-magnetic sheets) onto which electrodes are formed, are clamped or surrounded by magnetic body portions 14, 15*a*, 15*b*, 16*a* and 16*b* to form a chip body 19, on which external electrodes are provided to form a laminated transformer 12. The coil forming unit 13 consists on an alternated laminate of the non-magnetic layers (non-magnetic sheets) 17 and the electrode layers (electrodes) 18. The magnetic body portion 14 is formed in the center of the coil forming unit 13. The magnetic body portions 15*a*, 15*b* are formed on the upper and lower faces of the coil forming unit 13 by laminating the non-magnetic green sheets (magnetic sheets). The magnetic body portions 16*a*, 16*b* are formed on the side faces of the coil forming unit 13. The lead-out electrodes 31, 32 and 33, 34 at ends of a primary coil and a secondary coil respectively are exposed to the side faces of the coil forming unit 13. The external electrodes 10*a*, 10*b*, 11*a* and 11*b* are connected to the lead-out electrodes 31, 32 and 33, 34 respectively. As such, the electrode layers 18 are surrounded by the non-magnetic layers 17, and the non-magnetic layers 17 are covered by the magnetic body portions 14, 15*a*, 15*b*, 16*a* and 16*b*, thereby forming a closed magnetic circuit.

Next, the method of manufacturing the laminated transformer is described with reference to the accompanying drawings.

Figure 4:
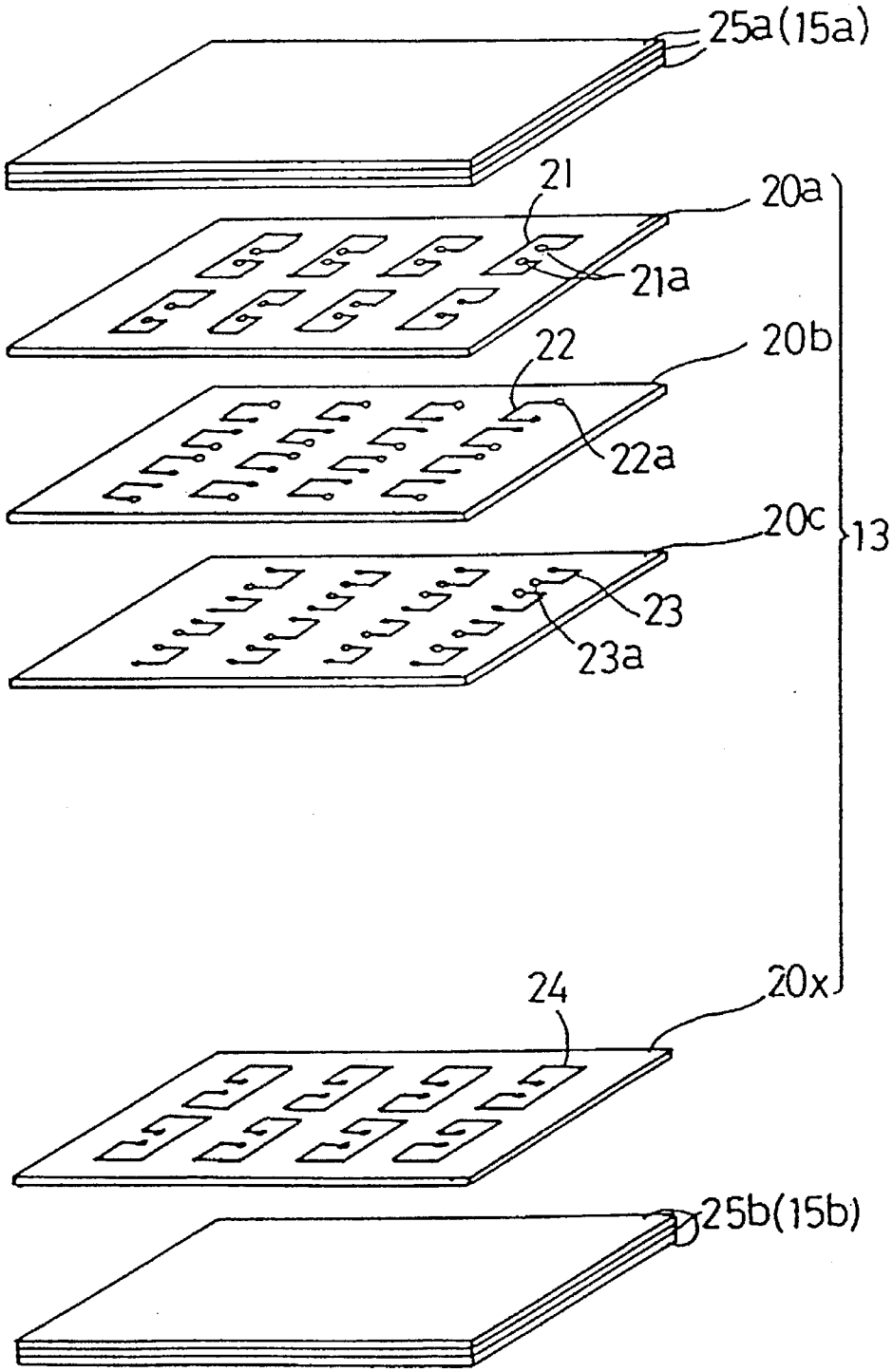
FIG. 4 is an exploded perspective view showing a laminating state of non-magnetic sheets and electrodes forming a laminated transformer.
Figure 5A:
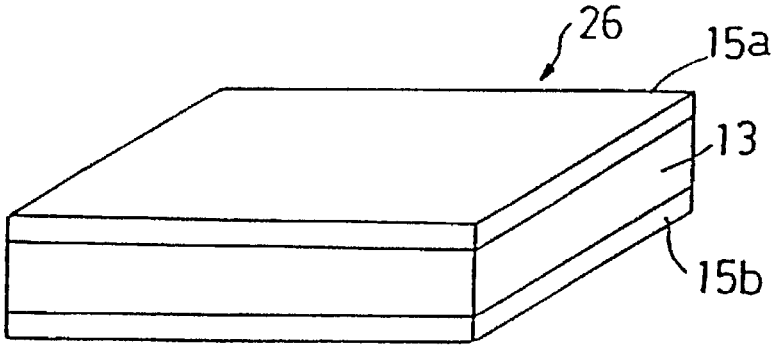
FIG. 5 is a view showing an intermediate product for explaining the manufacturing process of a laminated transformer, in which FIGS. 5(*a*), (*b*), and ( *c*)are perspective views respectively showing a state where a block is processed.
Figure 5B:
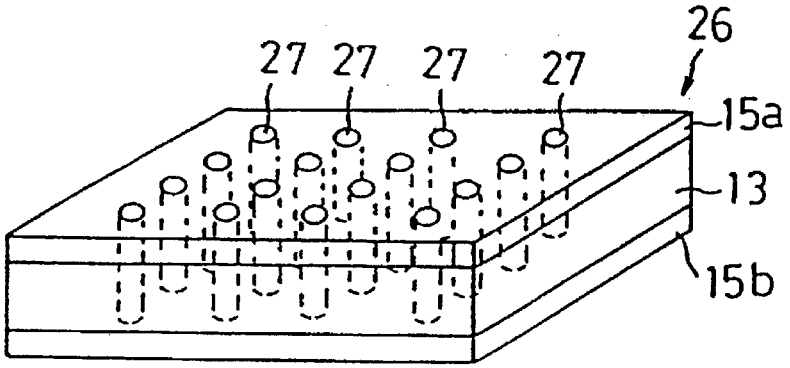
Figure 5C:
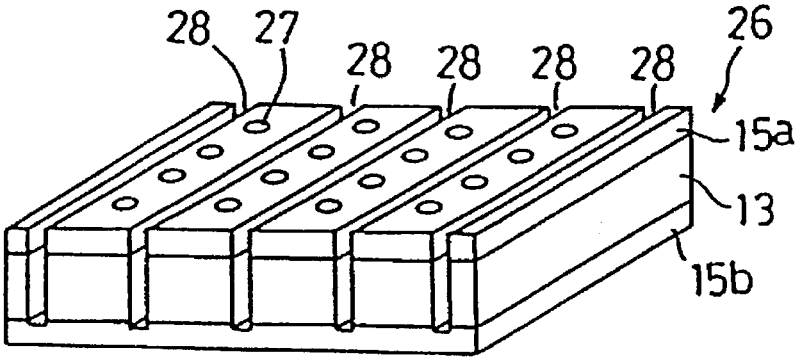
Figure 6:
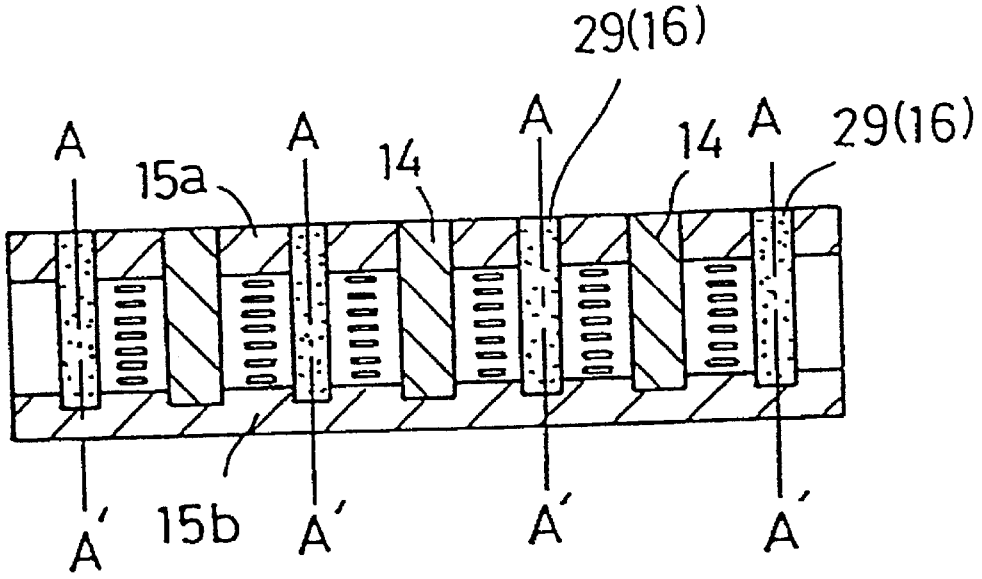
FIG. 6 is a perspective view of a product in a further later process for explaining the manufacturing process of a laminated transformer.
Figure 7:
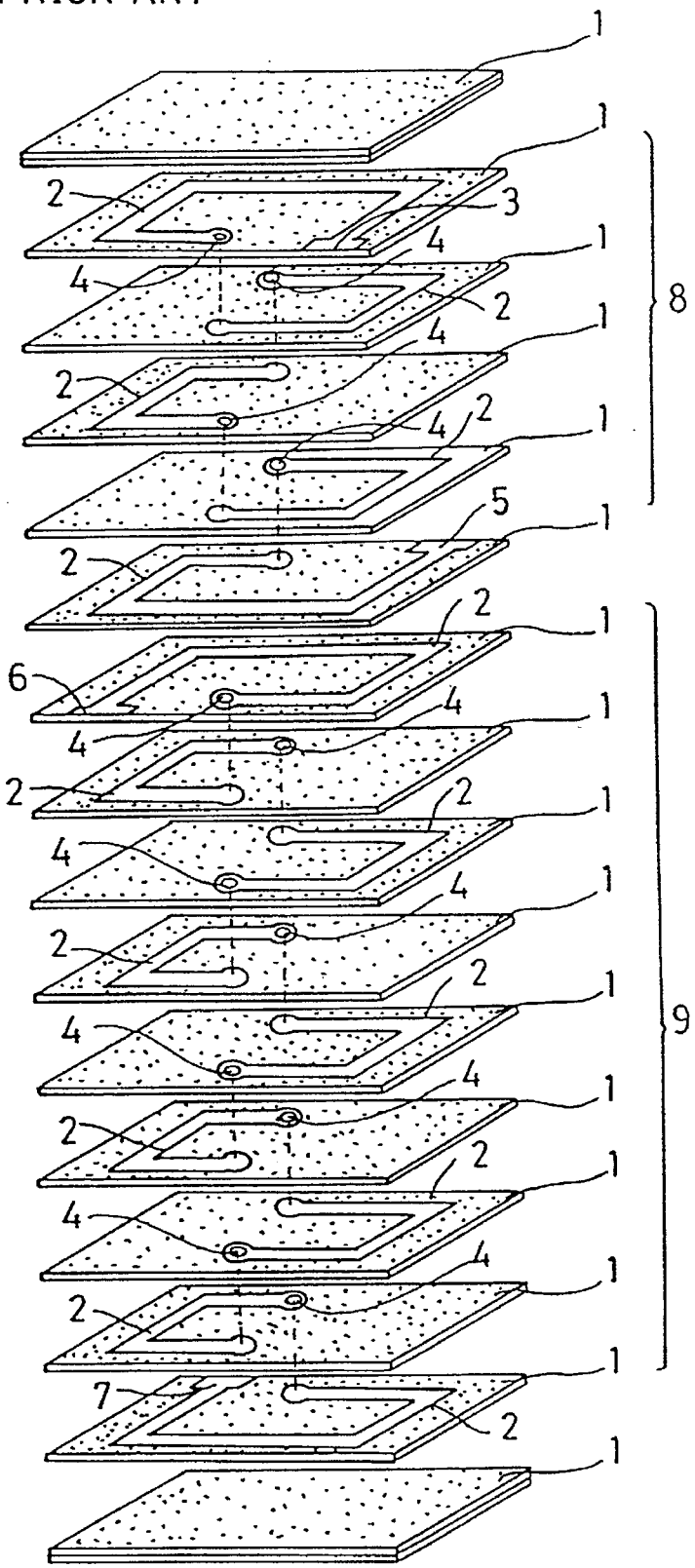
FIG. 7 PRIOR ART
FIG. 7 is an exploded perspective view showing a laminating state of magnetic sheets and electrodes forming a conventional laminated transformer.
Figure 8:
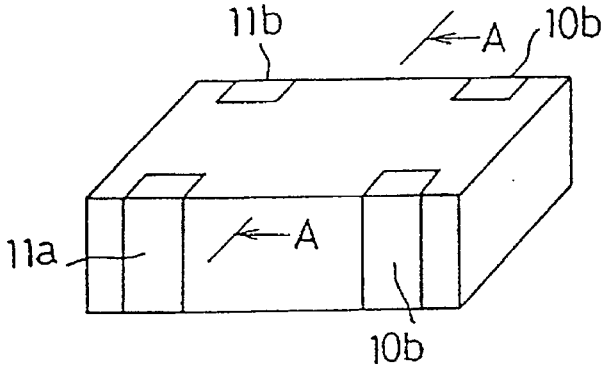
FIG. 8 PRIOR ART
FIG. 8 is a perspective view of a conventional laminated transformer.
Figure 9:
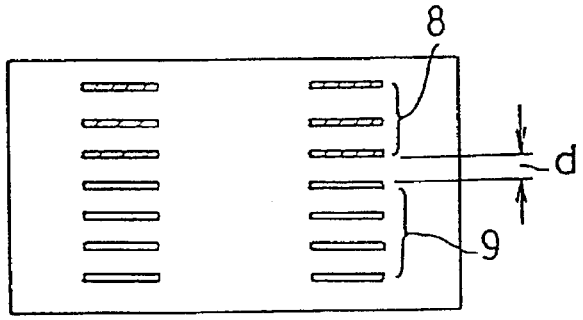
FIG. 9 PRIOR ART
FIG. 9 is a sectional view schematically showing an internal structure of the laminated transformer shown in FIG. 8.
Figure 10:
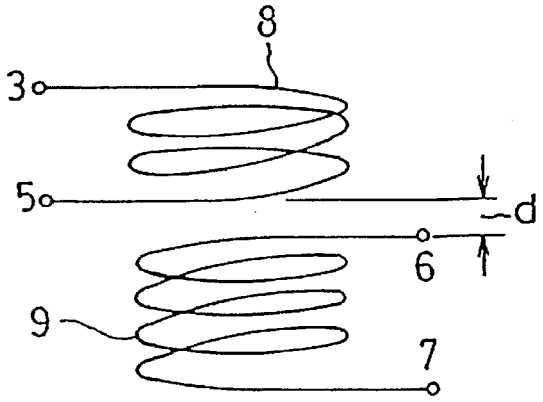
FIG. 10 PRIOR ART
FIG. 10 is an equivalent circuit diagram of the laminated transformer shown in FIG. 8.

FIG. 4 through FIG. 6 are views showing an intermediate product for explaining the manufacturing process of the laminated transformer.

As shown in FIG. 4, a plurality of sets of coiling electrodes 21, 22, 23, . . . , 24 are printed and formed on the non-magnetic sheets 20*a*, 20*b*, 20*c*, . . . , 20*x*. In the non-magnetic sheets, 20*a*, 20*b*, 20*c*, . . . , 20*x*, through holes 21*a*, 22*a*, 23*a*, . . . , are formed corresponding to the coiling electrodes 21, 22, 23, . . .

On the upper and lower outermost, layers of the non-magnetic sheets 20*a* and 20*x*, several magnetic sheets 25*a*, 25*b* are respectively disposed and are laminated and pressed to clamp the non-magnetic sheets 20*a* to 20*x* therebetween to form a block 26, in which a plural number of laminated transformer elements are arranged, as shown in FIG. 5(*a*).

In the block 26, the coil forming unit 13 having the non-magnetic layers 17 and the electrode layers 18 is formed by the non-magnetic sheets 20 having the coiling electrodes 21, 22, 23, . . . , 24, and the magnetic body portions 15*a*, 15*b* are formed by the magnetic, sheets 25*a*, 25*b*.

The coiling electrodes 21, 22, 23, . . . , 24 are connected by the through holes to form the primary and secondary coils having a predetermined number of turns.

Subsequently, as shown in FIG. 5(*b*) in plan, holes 27 are formed perpendicularly in the center of winding coiling electrodes 21, 22, 23, . . . , 24. The holes 27 are drilled as far as the lower magnetic body portion 15*b* but not penetrating therethrough. As shown in FIGS. 5(*b*) and 5(*c*), the holes 27 are formed in mutually perpendicular rows.

Next, as shown in FIG. 5(*c*), slits 28 are formed parallel to a first set of parallel rows of holes 27 and perpendiculat to the rows of holes which are mutually perpendicular to the first set of parallel rows of holes 27. The slits 28 are formed between the individual coils and are parallel to the direction in which the internal electrodes are exposed to the outside on the individual transformers element at the cutting process.

Next, a magnetic paste 29 is filled in the holes 27 in the center of the coils and the slits 28. Then, the magnetic paste 29 is dried to form the block. Thereafter, the block is cut in the direction perpendicular to the slits 28, and a plurality of groups of transformer elements, each formed as a bar as shown in section in FIG. 6 are formed. Subsequently, the transformer element bars are cut along lines A–A' in FIG. 6, thereby individual elements having the configuration as shown in FIG. 6 are formed. By sintering this element, the non-magnetic body and the magnetic body are integrated into the chip 19. In the chip 19, as shown in FIG. 2, after sintering and before coating the external electrodes, one end 31 of the internal electrode of the primary coil and the other end 32 on the rear side, and one end 33 of the internal electrode of the secondary coil and the other end 34 on the rear side are exposed from the non-magnetic layer 17.

And, as shown in FIG. 1, the primary external electrodes 10*a*, and 10*b*, and the secondary external electrodes 11*a* and 11*b* are formed.

As mentioned heretofore, according to the present invention, since the coil forming unit of the laminated transformer is formed by sintering and integrating the alternated laminate of the non-magnetic layers and the electrode layers, the dielectric strength of the primary and secondary coils is increased. Furthermore, since the coil is surrounded by the non-magnetic material and the coil forming unit is embedded by the magnetic body to form the closed magnetic circuit, the coupling coefficient can be increased and a high inductance is obtained. Besides, since the stray capacitance can be reduced, a small-sized transformer having a good high-frequency characteristic and adaptability for high energy can be obtained.

The method of forming the magnetic body portion surrounding the coils of the laminated transformer according to the present invention is not limited to the above-mentioned embodiment. For example the magnetic body portion may be formed beforehand. Besides, the present invention may be changed and modified by those skilled in the art without departing from the spirit and scope of the invention.

While the present invention has been particularly described and shown, it is to be understood that such description is used merely as an illustration and example rather than limitation, and the spirit and scope of the present invention is determined solely by the terms of the appended claims.

What is claimed is:

1. A method of manufacturing laminated transformers comprising the steps of:

forming a U-shaped electrode layer on a non-magnetic green sheet;

forming at least one other U-shaped electrode layer on a non-magnetic green sheet to thereby provide a plurality of non-magnetic green sheets on which a U-shaped electrode layer has been formed;

laminating said plurality of said non-magnetic green sheets to form a laminate unit comprising alternate layers of said non-magnetic green sheets and said electrode layers;

laminating said laminate unit with magnetic clamping sheet means such that said laminate unit is disposed between said clamping sheet means to thereby form a laminate body;

pressing said laminate body to form a pressed laminate body;

forming side magnetic body portions and central magnetic body portions in said pressed laminate body such that said pressed laminate body with said side body portions and said central magnetic body portions form an assembly block;

cutting said assembly block into a plurality of assembly units with each of said assembly units forming an individual transformer element; and sintering said individual transformer elements.

2. A method of manufacturing a laminated transformer according to claim 1 wherein said step of forming said side magnetic body portions comprises applying a magnetic paste to said pressed laminate body, and further comprising drying said magnetic paste.

3. A method of manufacturing a laminated transformer according to claim 1 wherein said step of forming said side magnetic body portions in said pressed laminate body comprises forming parallel slits in said pressed laminate body, disposing a magnetic paste in said slits, and drying said magnetic paste.

4. A method of manufacturing a laminated transformer according to claim 3 wherein said step of laminating said laminate unit with said magnetic clamping sheet means comprises applying one of said clamping sheet means to one side of said laminate unit and applying another of said clamping sheet means to the other side of said laminate unit, said step of forming said parallel slits comprises forming said parallel slits to extend through said one clamping sheet means and through said pressed laminate body.

5. A method of manufacturing a laminated transformer according to claim 4 wherein said one clamping sheet means and said other clamping sheet means each comprise a plurality of magnetic sheets.

6. A method of manufacturing a laminated transformer according to claim 9 wherein said step of disposing said magnetic paste in said parallel slits comprises disposing said magnetic paste in said parallel slits which extend through said pressed laminated body and which terminate at said other clamping sheet means.

7. A method of manufacturing a laminated transformer according to claim 4 wherein said step of forming said parallel slits comprises terminating said parallel slits at said other clamping sheet means such that said slits do not extend through said other clamping sheet means.

8. A method of manufacturing a laminated transformer according to claim 3 wherein said step of cutting said assembly block comprises cutting through said dried magnetic paste in said slits.

9. A method of manufacturing a laminated transformer according to claim 3 wherein said step of cutting said assembly block comprises cutting said assembly body along a first plurality of parallel cut lines with each of said parallel cut lines being parallel to said parallel slits.

10. A method of manufacturing a laminated transformer according to claim 9 wherein said step of cutting said assembly block along said first plurality of cut lines comprises cutting said dried magnetic paste in said slits.

11. A method of manufacturing a laminated transformer according to claim 9 wherein said step of cutting said assembly block comprises further cutting said assembly block along a second plurality of parallel cut lines which extend perpendicular to said first plurality of parallel cut lines.

12. A method of manufacturing a laminated transformer according to claim 1 wherein said step of forming said central body portions in said pressed laminate body comprises forming a plurality of central openings in said pressed laminate body, disposing a magnetic paste in said central openings, and further comprising drying said magnetic paste.

13. A method of manufacturing a laminated transformer according to claim 12 wherein said step of laminating said laminate unit with said magnetic clamping sheet means comprises applying one magnetic clamping sheet means to one side of said laminate unit and applying another magnetic clamping sheet means to the other side of said laminate unit, said step of forming said central openings comprising forming said central openings to extend through said pressed laminate body and through said one magnetic clamping sheet means.

14. A method of manufacturing a laminated transformer according to claim 13 wherein said one clamping sheet means and said other clamping sheet means each comprise a plurality of magnetic sheets.

15. A method of manufacturing a laminated transformer according to claim 13 wherein said step of forming said central openings comprises terminating said central openings at said other clamping sheet means such that said central openings do not extend through said other clamping sheet means.

16. A method of manufacturing a laminated transformer according to claim 15 wherein said step of disposing said magnetic paste in said central openings comprises disposing said magnetic paste in said central openings which extend through said pressed laminate body and which terminate at said other clamping sheet means.

17. A method of manufacturing a laminated transformer according to claim 1 wherein said step of forming said side magnetic body portions in said pressed laminate body comprises forming parallel slits in said pressed laminate body and disposing a magnetic paste in said slits, and further comprising disposing said central magnetic body portions in said pressed laminate body in spaced array along two mutually perpendicular sets of rows with one set of rows being parallel to said slits and the other set of rows being perpendicular to said slits, said cutting step comprising cutting said assembly block along first cut lines which are perpendicular to said slits and which extend between said spaced central magnetic body portions in said second set of rows, said cutting step further comprising cutting said assembly block along second cut lines which are parallel to said slits and which extend between said spaced central magnetic body portions in said first set of rows to thereby form said assembly units.

* * * * *